US006299754B1

(12) United States Patent
Mertens et al.

(10) Patent No.: US 6,299,754 B1
(45) Date of Patent: Oct. 9, 2001

(54) PH SENSITIVE REFERENCE ELECTRODE IN ELECTROLYTIC DESILVERING

(75) Inventors: Patrick Mertens, Vrasene; Benny Jansen, Geel; Werner Van de Wynckel, Mortsel; Frank Michiels, Arendonk, all of (BE)

(73) Assignee: Agfa-Gevaert, Mortsel (BE)

( * ) Notice: Subject to any disclaimer, the term of this patent is extended or adjusted under 35 U.S.C. 154(b) by 1491 days.

(21) Appl. No.: 08/651,442

(22) Filed: May 22, 1996

Related U.S. Application Data

(63) Continuation of application No. 08/140,472, filed on Oct. 25, 1993, now abandoned.

(30) Foreign Application Priority Data

Nov. 10, 1992 (EP) ..... 92203439

(51) Int. Cl.[7] ..... C25C 1/20; G01N 27/30

(52) U.S. Cl. ..... 205/263; 204/412; 204/433; 204/435; 205/687; 205/775; 205/787.5

(58) Field of Search ..... 204/109, 412, 204/420, 433, 435; 205/775, 789.5, 787.5, 263, 687

(56) References Cited

U.S. PATENT DOCUMENTS 2,850,448 * 9/1958 Stricker ..... 204/284
3,306,837 * 2/1967 Riseman et al. ..... 204/420
4,120,759 * 10/1978 Asami ..... 204/109
4,255,242 * 3/1981 Freeman ..... 204/196
4,362,608 * 12/1982 Biles et al. ..... 204/109
4,377,456 * 3/1983 DeMeester et al. ..... 204/109
4,406,753 * 9/1983 Blake et al. ..... 204/109
4,978,433 * 12/1990 Iwano et al. ..... 204/109
5,017,273 * 5/1991 Woog ..... 204/109
5,200,054 * 4/1993 Glenn et al. ..... 204/109

OTHER PUBLICATIONS

Hackh's Chemical Dictionary, 4th ed., (1969), p. 542.*

* cited by examiner

*Primary Examiner*—T. Tung
(74) *Attorney, Agent, or Firm*—Breiner & Breiner, L.L.C.

(57) ABSTRACT

An apparatus is disclosed for electrolytic desilvering of photographic processing solutions, more particularly fixing solutions or bleach-fixing solutions, comprising an electrolysis unit equiped with a monitoring system comprising a cathode, an anode and a reference electrode, characterized in that said reference electrode is a pH sensitive electrode. The desilvering is preferably performed under potentiostatic conditions. Whe using a pH sensitive reference electrode the cathodic plating potential is automatically corrected for pH changes. A preferred pH sensitive electrode is a glass electrode.

9 Claims, 6 Drawing Sheets

PH SENSITIVE REFERENCE ELECTRODE IN ELECTROLYTIC DESILVERING

This is a continuation of application Ser. No. 08/140,472 filed Oct. 25, 1993, now abandoned.

FIELD OF THE INVENTION

The present invention relates to an apparatus for the electrolytic desilvering of used photographic solutions, more particularly used fixing solutions or used bleach-fixing solutions.

BACKGROUND OF THE INVENTION

Electrolytic silver recovery from used photographic fixers is a common way to extend the lifetime of these fixers.

Important in the silver recovery process is the control of the electrochemical processes taking place at the anode and the cathode. There are a number of ways to operate an electrolytic desilvering cell. In many setups, a constant anode versus cathode potential is applied. When the desilvering of the solution reaches its end, a decrease in the electrolytic current occurs, and in this type of cells the process is usually shut off when the current decreases below a determined preset value. The disadvantage of the approach is that the deposition potential is not exactly controlled in many practical situations, and that the actual potential difference between the cathode and the solution (the "cathode potential") is unknown and varies during desilvering, causing unneccessary side reactions or a not necessarily optimal desilvering speed. In other setups, galvanostatic desilvering (constant current) of the fixer solution is carried out. In this setup, it is important to shut off the current when the silver content drops below a certain value, since unwanted side reactions and eventually sulphiding of the electrode may occur. Using more intelligent electronic circuitry, it is conceivable to develop setups which control the electrolytic desilvering cell using the cell resistance and the dependence of the cell resistance on the applied anode-cathode potential difference (e.g. first and second derivative of the current versus potential curve).

The above setups all suffer from the disadvantage that the actual plating potential is often not known when used in practical applications where the actual fixing solution to be desilvered consists of the starting pure fixing solution and a number of other components such as developer carried over from the developer tank, replenishment solution, additives, reaction products of development or of a previous electrolytic desilvering, etc.

If the desilvered fixing solution is to be reused, it is desirable to minimize the side reactions taking place at the anode and cathode which would give rise to unwanted by-products.

Three electrode setups, as commonly used in electrochemical instrumentation such as polarography instruments, allow a much better control of the silver deposition conditions, since the potential difference between the cathode and the fixer solution can be controlled. In this setup, the potential difference between cathode and anode is controlled by a feedback mechanism which keeps the potential difference between the cathode and the reference electrode, used to monitor the potential of the solution, at a constant value (potenstiostatic control). This allows optimal control of the plating reaction, since the reactions taking place at the electrodes are essentially controlled by the potential difference between the electrode and the solution.

In order to achieve a low residual silver level in the desilvered solution, and high desilvering speeds, the cathode potential should be kept sufficiently low, meaning sufficiently negative, versus the reference electrode. The lower the potential of the cathode, however, the more unwanted side reactions, e.g. sulphite ion reduction, are likely to occur. At still lower (very negative) potentials, sulphiding (formation of $Ag_2S$) of the cathode occurs. These side reactions at the catode not only consume sulphite but are inevitably accompanied by side reactions at the anode giving rise to supplemental unwanted by-products. In order to avoid these side reactions, it is therefore desirable to work at the lowest potential of the cathode not giving rise to these side reactions.

In establishing the optimal cathode potential for desilvering some problems occur when conventional reference electrodes are used.

(1) Reference electrodes which are known to be used as reference electrodes for electrolytic desilvering instruments are e.g. calomel type electrodes or Ag/AgCl electrodes as disclosed in scientific publication "Three-electrode control procedures for electrolytic silver recovery", Austin C. Cooley, Journal of Imaging Technology, volume 10, Number 6, December 1984, pagina 233–238. In view of its ecological implications the calomel type electrode containing Hg is not a desirable option. On the other hand Ag/AgCl electrodes need maintenance, especially when used in a solution tending to dissolve the materials used in the reference electrode. Other possible reference electrodes usually need maintenance if they are to provide stable potentials on the long term. when continuously used in a fixer solution. Moreover many commercial reference electrodes are not pressure compensated and are therefore not the best solution for use in systems where the fixing solution is pressurized (hydrostatic pressure, or pressure e.g. generated by pumps, etc . . . )

(2) The potential at which the reduction of sulphite starts to take place is dependent on the pH of the fixing solution. Therefore, the potential of optimal desilvering is dependent on the nature of the fixer used and on other parameters such as the pH of the developer bath, the presence or the absence of intermediate rinsing, the degree of carry-over from developer to fixer (dependent itself on e.g. the film type), the buffering capacities of the developer and the fixer solution, etc. In practical terms this means there is no common potential of optimum desilvering for various fixers having different pH values. For optimal desilvering, every fixer solution with a different pH would require a different potential difference between the reference electrode and the cathode. Therefore adjustments are necessary when the pH of the fixing solution changes due to differences in pH as a result of e.g. the use of additives, differences in carry over, or pH variations due to the reaction products of development or to a previous electrolytic desilvering.

It is an object of the present invention to provide an apparatus for the electrolytic desilvering of used photographic fixers or bleach-fixers which allows the establishment of an optimal desilvering potential which is independent over a broad range of the pH of the fixer or bleach-fixer.

It is a further object of the present invention to provide an electrolytic desilvering apparatus comprising a reference electrode which requires little or no maintenance.

It is a still further object of the present invention to provide an electrolytic desilvering apparatus comprising a reference electrode which is insensitive to hydrostatic pressure variations.

SUMMARY OF THE INVENTION

The objects of the present-invention are realized by providing an apparatus for performing electrolytic desilvering of used photographic solutions, more particularly used fixing or bleach-fixing solutions, comprising an electrolysis cell equiped with a monitoring system comprising a cathode, an anode and a reference electrode, characterized in that said reference electrode is a pH sensitive electrode.

In a preferred embodiment the pH sensitive electrode is a glass electrode.

The advantages of the present invention are most perspicuous when the desilvering is controlled by a potentiostatic unit.

The present invention provides a solution to the problems discussed above. The use of a pH electrode as reference electrode in a three electrode setup automatically eliminates correction of the optimal desilvering potential as a function of the pH of the fixing solution. By keeping the cathode at a constant potential versus the pH sensitive electrode immersed in the fixing solution, corrections for pH variations will automatically be performed. Fixers at high pH values, where reduction of sulphite starts to occur at more negative potentials, will automatically be desilvered at lower (more negative) cathode potentials (defined ag potential of the cathode vs potential of the solution as e.g. measured by a saturated calomel electrode). Fixers at lower pH values, where the side reaction at the cathode starts to occur at higher (less negative) values of the cathode potential, will automatically be desilvered at higher cathode potentials (defined as above). This means that the desilvering potential stays optimal, even when the pH of the fixing solution varies.

DETAILED DESCRIPTION OF THE INVENTION

As pH sensitive electrodes, all electrodes which show a pH dependence, e.g. a glass electrode, a hydrogen electrode, a quinhydrone electrode and an antimony electrode are useful. In a preferred embodiment a commercial glass electrode is used as reference electrode. A glass electrode provides a maintenance free electrode which moreover is insensitive to hydrostatic pressure variations. Tests showed that prolonged conservation in fixer solutions did not alter the response of the electrode (just a few milli-Volts or less variation in 6 months). Further on it was stated experimentally that exsiccation of the glass electrode did not cause serious problems: the potential of two pH electrodes which had been lying in the lab in dry condition for several years proved to be correct within 5 mV after 10 minutes stay in a fixer.

For optimal results with potentiostatic desilvering, the choice of the cathode potential is important, since a cathode potential which is too high (less negative) will result in a decreased desilvering speed and a less complete desilvering. When the potential is too negative, side reactions like the reduction of sulphite will occur and after the solution is desilvered, these unwanted side reactions will go on. Since the start potential of the reduction of sulphite depends on the pH, the use of a glass electrode allows to adjust the potential of the cathode to a fixed position with respect to the reduction of sulphite. It is possible to adjust the cathode potential to a value of e.g. 10 mV more positive than the start of the reduction of sulphite, independent of the pH, although in absolute terms (i.e. measured versus Saturated Calomel Electrode (SCE) or Normal Hydrogen Electrode (NHE)), the potential of the start of the reduction of sulphite is pH dependent.

In optimal conditions for desilvering of fixers, i.e. fixers which are neither to alkaline nor to acid, the cathode potential is preferrably about −560 mV versus a glass electrode having itself a potential of 244 mV versus NHE at pH 7.0. This provides the best desilvering from the viewpoint of residual silver and desilvering speed. However for fixers with a high pH value (about 8.0 or higher) it may be preferable to use a somewhat lower cathode potential, e.g. −460 mV versus glass electrode. This will result in a somewhat increased residual silver level (e.g. about 100 mg $Ag^+$/l instead of about 5 mg $Ag^+$/l), but such extremely low residual silver levels are not required anyway for fixers which are to be recycled. For fixers with a low pH value (e.g. pH 3.5 and below) the value of −560 mV is not recommended and more negative cathode potentials should be used, e.g. about −620 mV versus glass electrode, since otherwise insufficient desilvering will occur. In this case side reactions will tend to go on even after desilvering and the current should be interrupted by some mechanism when it drops below a preset threshold or has become constant. In practice however these fixers tends to suffer from other problems, e.g. sulphur precipitation.

In the case that inhibition of the cathode reaction occurs by the presence of photographic ingredients such as phenylmercaptotetrazole a more negative cathode than −560 mV should be used in order to counteract the effects of inhibition.

In a preferred embodiment the anode is positioned in the center of the electolysis cell and fixed at the bottom of it. The choice of the anode material will usually depend on a number of factors such as cost, mechanical properties. Useful anode materials include platinum, titanium covered with platinum, graphite and noble metals. Preferred materials are platinum and graphite.

In a preferred embodiment the cathode has a cylindrical form and is positioned near the wall of the electrolysis cell which has a cylindrical form too. Usable cathode materials include stainless steel, silver and silver alloys. A frequently used cathode material is stainless steel. This may cause starting up problems. The deposition of silver on the clean stainless steel surface shows an overpotential, and the deposition of the first layer of silver-may be hindered, resulting in low currents at the start of the electrolysis, and possibly also bad adhesion of the silver layer to the cathode. Mechanical pretreatment of the cathode (sand blasting, grinding) and/or "kick starting," the electrode (applying large current densities during the start period of about 10 seconds the potentiostatic unit being shut off) may largely overcome these problems. The choice of a silver containing cathode material may overcome these problems, but may be less cost-efficient.

The positioning of the pH sensitive electrode is of great importance in the concept of an electrolytic desilvering apparatus. Due to ohmic potential drops, which may be higher than 100 mV for electrolysis units with high current densities, the potential of the pH electrode is dependent on its position. In principle, the electrode is placed best between the anode and the cathode, as close as possible to the cathode. This may, however, cause troubles as more and more silver is deposited on the cathode, which thus is growing thicker. When the electrode is placed somewhat further away from the cathode, say 20 mm, ohmic potential drops will cause the potentiostatic desilvering not to be truely potentiostatic. This can be accounted for by making an intelligent potentiostat which compensates for this potential drops (so-called I.R. compensation), or by a well chosen positioning of the pH sensitive reference electrode. For instance, in case of a cylindrical electrolysis cell with an anode in the center, the pH sensitive reference electrode can be placed immediately near a hole in the cathode outside the space between cathode and anode (see example 6 furtheron). In this case, the reference electrode experiences the potential immediately in front of the cathode, and the ohmic potential drop is largely absent, without impeding the deposition of large quantities of silver on the cathode. The absence of a reference electrode in the space between the anode and the cathode gives more freedom to produce user-friendly desilvering cells.

As a geometrical alternative, up side down mounting of the pH sensitive electrode through the bottom of the electrolysis cell may result in a more user-friendly apparatus, as e.g. no electrical connections hinder the removal of the top of the apparatus. For this purpose, modified glass electrodes may be used.

The term "used fixers or mused fixing solution" mentioned in this application should be interpreted in a broad sense as including any solution containing a silver complexing agent, e.g. thiosulphate or thiocyanate. sulphite ions as anti-oxidant, and free plus complexed silver ions as a result of the fixation process itself. Also included in the scope of the term are pretreated solutions, e.g. concentrated or diluted used fixing solutions, or solutions containing substantial amounts of carried-over developer or rinsing water. Apart from its essential ingredients the used fixers can contain well-known conventional substances, e.g. wetting agents, sequestring agents, buffering agents. pH adjusting compounds, etc.

The apparatus of the present invention can also be used for desilvering used bleach-fixing solutions. These bleach-fixing baths preferably contain similar ingredients as fixing baths plus conventional bleaching agents like complexes of iron(III) and polyaminocarboxylic acids, e.g. iron(III)-ethylenediamine-tetraacetic acid mono sodium salt.

The desilvering of the used solutions by means of the apparatus of the present invention can be performed batch-wise. Alternatively it can be performed on-line, the electrolysis unit being connected to the fixing solution forming part of a continuous processing sequence, and continuously operating during this continuous processing sequence.

It will be easily understood that the apparatus of the present invention can also be used in applications where accurate potential control is unnessary, e.g. in desilvering a fixer which has to be discarded. In this case the specific advantage of correction of the plating potential for pH variations is irrelevant. However the advantage of using a maintenance free and pressure insensitive electrode remains valid.

The apparatus of the present invention can further contain a mechanism which automatically shuts off the electrolytic current when this current drops below a certain preset value or when the change in current becomes very small. In this way desilvering can be performzed during week-end or holidays without danger for excessive side reactions.

The following examples and accompanying figures illustrate the present invention without however limiting it hereto.

EXAMPLES

Example 1

Figure 1:
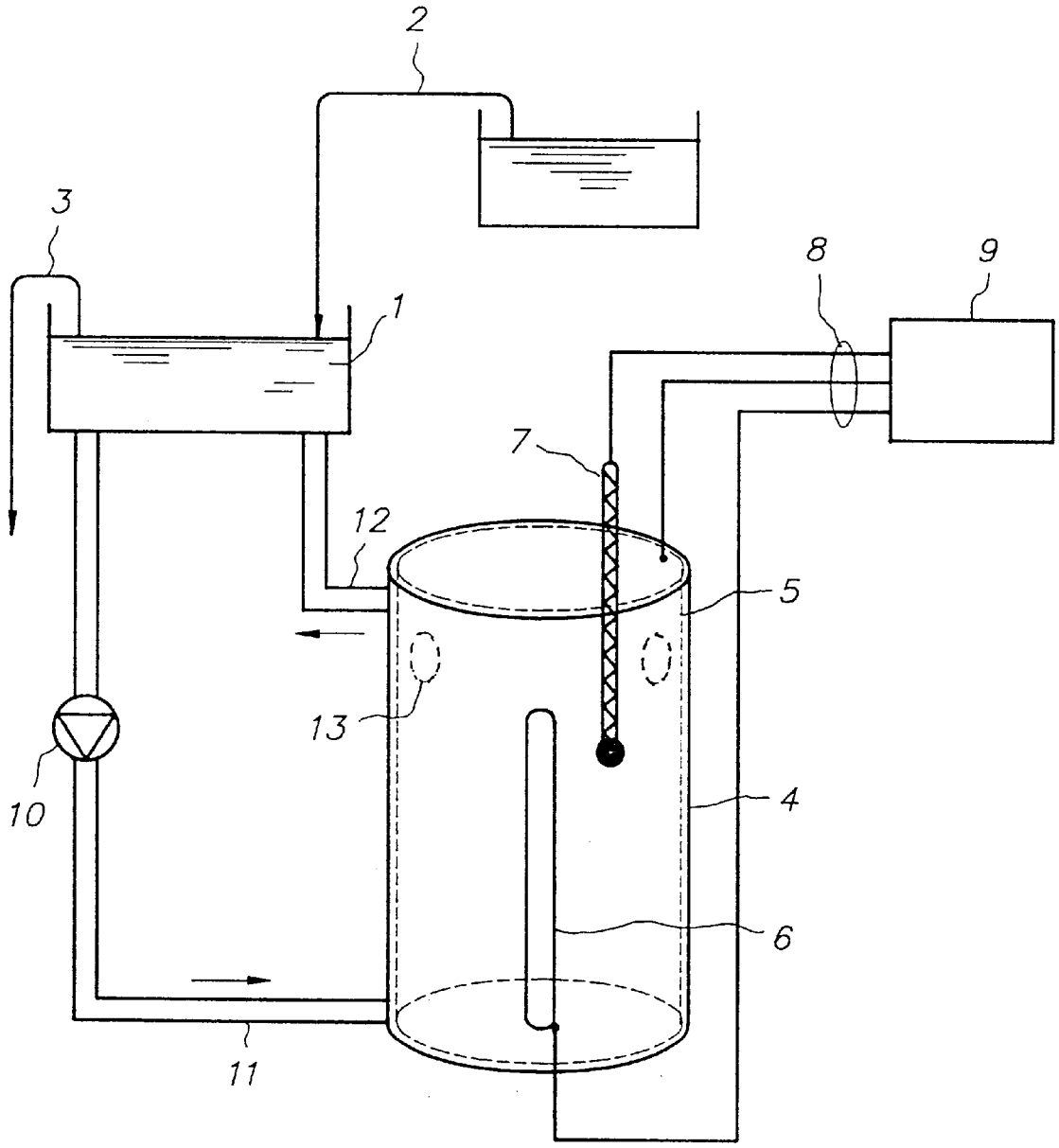
FIG. 1 is a schematic representation of a desilvering apparatus according to the present invention.

This example describes a set-up and a procedure for fixer desilvering using the apparatus of the present invention. FIG. 1 represents a scheme of this set-up.

The potentiostat-(9) was a home-made apparatus. The cathode (5) was connected to the entrance "work electrode". The anode (6) was connected to the entrance "auxiliary electrode". As pH sensitive reference electrode a glass electrode (7) was connected to the entrance "reference electrode".

The electrolysis cell (4) was a cylindrical cell with a diameter of 120 mm. The anode (6) was positioned at the center and consisted of platinated titanium. The cylindrical cathode (5) was positioned at a distance of about 10 mm from the wall of the cell and showed some holes (13) at the upper part. This cathode was made of silvered stainless steel. The glass electrode (7), was a YOKOGAWA SM21/AG2 glass electrode. The electrolysis cell was connected to a fixer container (1) filled at the start of the experiment with a fixer consisting for 90 % of a five times diluted pure fixing solution (F1), and contaminated with 10% of a three times diluted developer solution (D1).

The composition of concentrated fixing solution (F1) was

| | |
|---|---|
| ammonium thiosulphate | 685 g |
| sodium sulphite | 54 g |
| boric acid | 25 g |
| sodium acetate.3 aq. | 70 g |
| acetic acid | 40 ml |
| water to make | 1 l |

After 5 times dilution the pH was 5.3.

The composition of the-concentrated developer solution (D1) was

| | |
|---|---|
| hydroxyethyl-ethylenediamine-triacetic-acid | 7.5 g |
| potassium carbonate | 71 g |
| potassium sulphite | 196 g |
| sodium tetrapolyphosphate | 4 g |
| potassium bromide | 30 g |
| potassium hydroxide | 16 g |
| diethyleneglycol | 60 ml |
| hydroquinone | 60 g |
| Phenidone | 1.45 g |
| 1-phenyl-5-mercaptotetrazole | 90 mg |
| water to make | 1 l |

After 3 times dilution the pH was 10.5

The circuit further contained a pump (10) with filter which could deliver a flow rate up to about 20 l/min. The inlet (11) of the liquid was situated at the bottom and the liquid was pumped in in a way tangential to the wall in order to obtain good circulation. The outlet (12) was at the upper side. The total fixer volume in the whole circuit comprising electrolysis cell, tubes, pump and fixer container, was about 12 liter.

Figure 2:
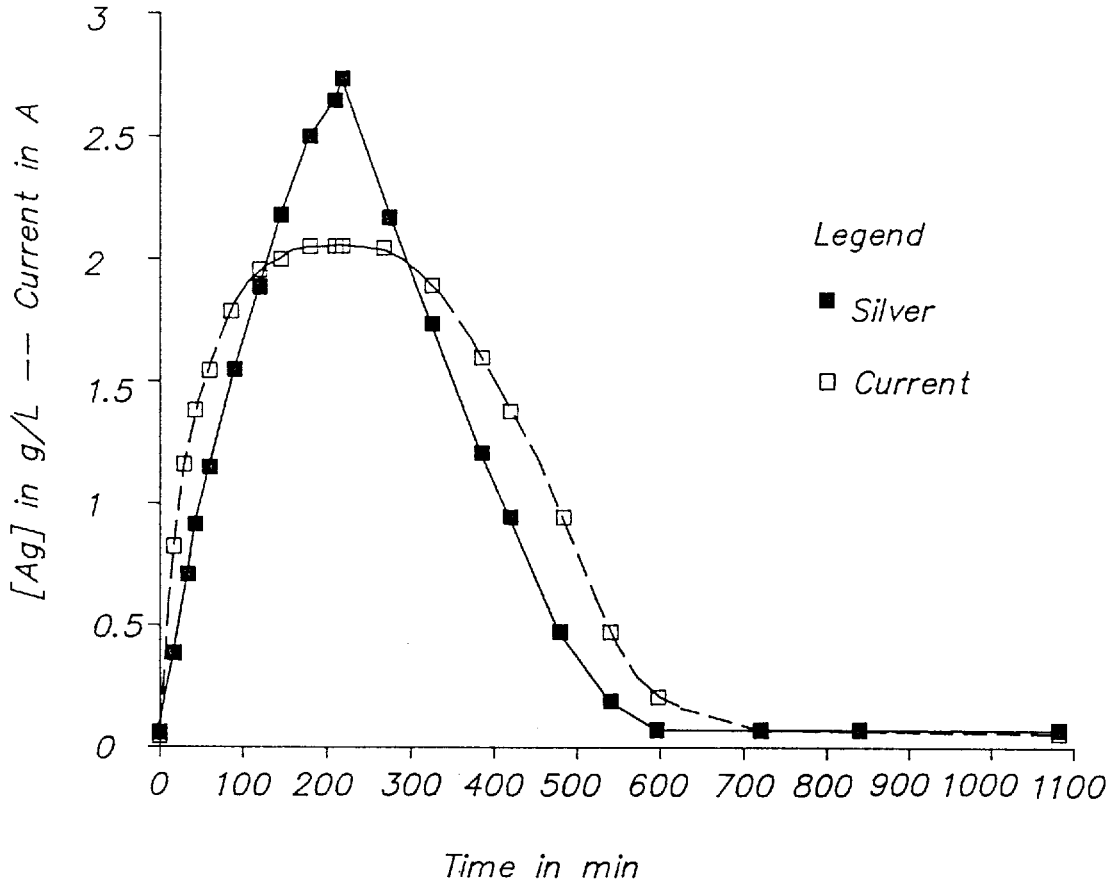
FIG. 2 represents the evolution of electrolytic current and silver content in a desilvering experiment (see example 1).

At the start of the experiment 7.5 liter of a second fixer (2) having the same basic composition as the first one but further containing 10 g complexed silver, added as silver chloride, was added to the container over a time period of 220 minutes. By means of an overflow (3) the total liquid volume was maintained constant. In this way the complexed silver concentration profile in function of time of a fixer in a continuous processing sequence was simulated. Together with the start of the addition of the silver rich fixer the desilvering was started. The potentiostat was regulated at a potential of −560 mV between cathode and glass electrode. FIG. 2 represents the evolution of electrolytic current and silver concentration as a function of time. The yield of the desilvering up to a residual silver concentration of 0.15 g/l was more than 90%. This illustrates that a low level of side reactions had taken place. After 24 hours of desilvering the residual current was 52 mA and the residual silver concentration was below 0.07 g/l. The quality of the silver deposited at the cathode was very good. After separation from the cathode the deposited silver looked metallic at the side which had adhered to the cathode and white or pale coloured at the other side.

Example 2

As explained above the optimal plating potential is situated just before (less negative than) the inflection point in the polarographic curve corresponding to the onset of sulphite reduction. Since the potential at this inflection point is independent on the silver content the optimal potential can be determined on silver free fixers.

In this example an apparatus similar to that of example 1 but showing other dimensions was used. The electrolysis cell had a volume of about 45 l. The cylindrical cathode was made of stainless steel and had a diameter of 40 cm. The glass electrode was positioned in front of a hole in this cathode. The anode consisted of 8 graphite bars circularly distributed at a distance of 5 cm from the cathode. The maximal possible current was 20 A when 2 à 3 g silver per liter were present.

Polarographic curves were established for silver free fixers having basic composition (F2) the pH being adjusted to respectively 4.2. 4.35, 4.65 and 5.2.

This basic composition of fixer (F2) was:

| | |
|---|---|
| Part (1): | |
| ammonium sulphate | 661 g |
| sodium sulphite | 54 |
| boric acid | 20 g |
| sodium acetate | 70 g |
| acetic acid | 48 ml |
| water to make | 1 l |
| Part (2): | |
| acetic acid | 29 ml |
| sulphuric acid 96% | 29 ml |
| aluminium sulphate | 22 g |
| water to make | 200 ml |

dilution: 111 part (1) +0.2 l part (2)+2.8 l water.

Table 1 summarizes the potentials of the cathode at which respectively 100, 200 and 400 mA current, due to sulphite reduction, were flowing through the cell, measured on the one hand versus a saturated calomel electrode and on the other versus a glass electrode.

TABLE 1

| current (mA) | pH fixer | potential versus SCE | potential versus glass el. |
|---|---|---|---|
| 100 | 4.2 | −434 | −597 |
| 100 | 4.35 | −450 | −600 |
| 100 | 4.65 | −462 | −595 |
| 100 | 5.2 | −492 | −599 |
| 200 | 4.2 | −448 | −608 |
| 200 | 4.35 | −464 | −614 |
| 200 | 4.65 | −477 | −611 |
| 200 | 5.2 | −510 | −615 |
| 400 | 4.2 | −466 | −628 |
| 400 | 4.35 | −483 | −634 |
| 400 | 4.65 | −498 | −637 |
| 400 | 5.2 | −532 | −640 |

It appears from table 1 that, contrary to measuring versus SCE, measuring versus the glass electrode allows to define a unique, i.e. pH independent, potential at which a certain current is used in unwanted side reactions. This allows to control the amount of side reactions in a much easier way. If e.g. side reactions corresponding to 100 mA of current are acceptable (corresponding to a decrease of about 1% of the sulphite overnight), the potential to be applied is −600 mV versus glass, independent of the pH of the fixer solution.

Example 3

This example deals with desilvering experiments of two different fixers with a different pH value using a potentiostatic control with on the one hand a SCE as reference electrode and a glass electrode on the other. The desilvering was performed using the apparatus of example 2.

The fixing solutions used were:

fixer A: 91% of diluted fixer (F2) (see example 2)+9% of a diluted developer (D2); the composition of (D2) was similar to that of (D1) with the exception that it contained some amount of hardening agent glutaraldehyde fixer B: 91% of diluted fixer (F1). defined in example 1. +9% of diluted developer (D2).

Both fixers contained between 4 g/l of silver added as AgCl.

The desilvering was performed at a potential of −400 and −460 mV versus SCE on the one hand, and at −560 mV versus a glass elevtrode on the other. In these experiments a residual current after desilvering of 300 mA was tolerated.

After electrolysis, the fixers were found to have pH values of 4.2 and 5.2. approximately the same-as the start pH values.

Table 2 summarizes the residual currents (I), measured after desilvering of the solution, and the measured residual silver contents (g/l) of the fixers.

TABLE 2

| | fix. A pH 4.2 | fix. B pH 5.2 |
|---|---|---|
| (a) versus SCE | | |
| −400 mV vs SCE | 0.3 g/l Ag I = 300 mA | 0.2 g/l Ag I = 30 mA |
| −460 mV vs SCE | <<0.3 g/l Ag I > 5A | 0.04 g/l Ag I = 100 mA |

TABLE 2-continued

| | fix. A pH 4.2 | fix. B pH 5.2 |
|---|---|---|
| (b) versus glass | | |
| −560 mV vs glass | 0.3 g/l Ag I = 300 mA | 0.04 g/l Ag I = 100 mA |

As it is clear from table 2 the use the SCE as reference electrode will not give always optimal performance. When the cathode potential is adjusted to −400 mV vs SCE, the high pH fixer (fixer B) will not be suffiently desilvered, since desilvering to 0.04 g/l is possible without a dramatic increase of the residual current, as is proved by the experiment at −460 mV. Adjusting the cathode potential to −460 mV vs SCE, causes large residual currents for low pH fixer A, giving rise to unnecessary side reactions. Optimal performance is reached only when the potential is adjusted specifically depending on the pH of the fixer.

However, in this case of the use of a glass electrode, both fixers are desilvered to the optimal residual silver content (lowest silver concentration and highest desilvering-speed without appreciable side reactions). Only one and the same cathode potential adjustment allows good desilvering characteristics for both fixers.

Example 4

Figure 3:
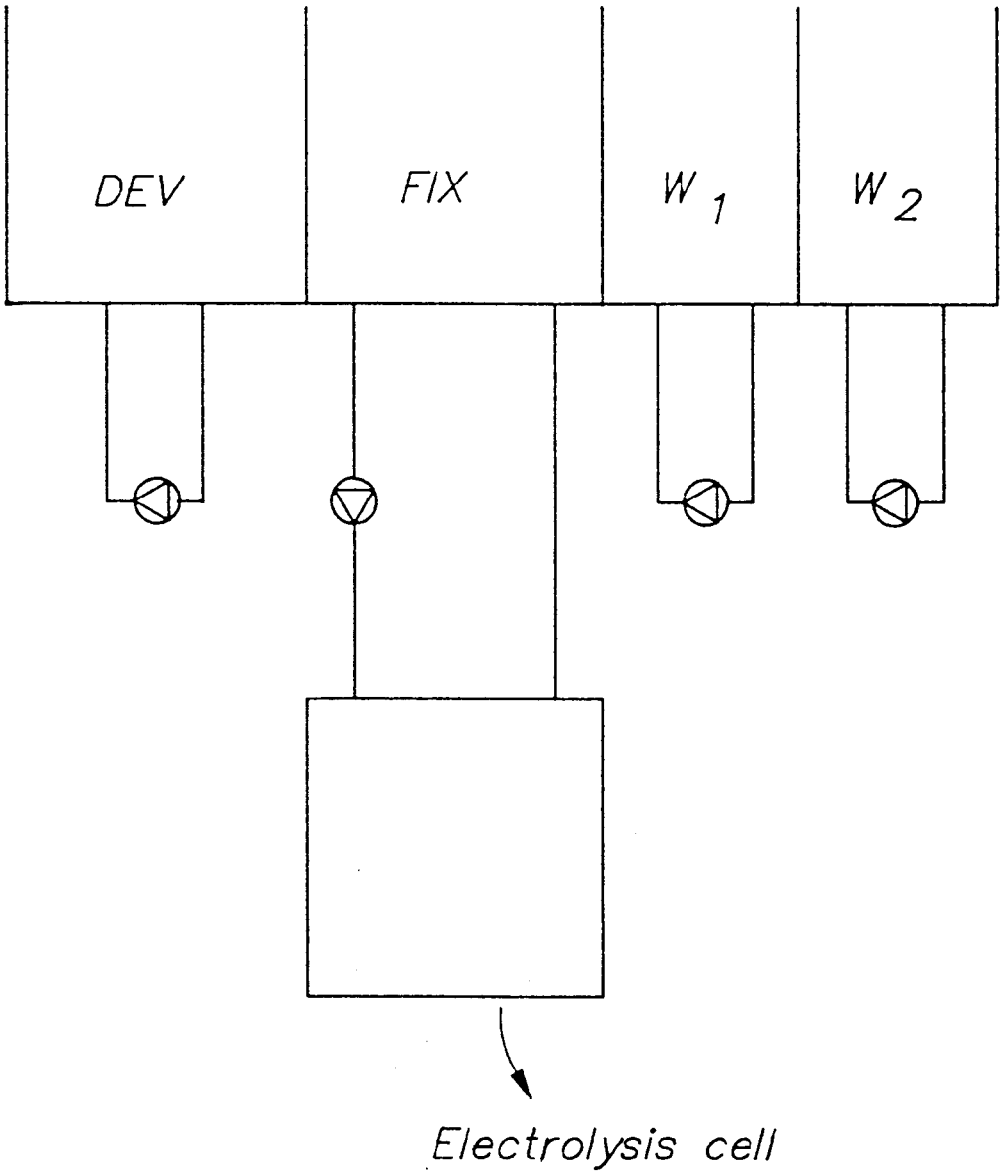
FIG. 3 illustrates the use of an apparatus according to the present invention in a continuous automatic processor (see example 4).

In this example the apparatus described in example 1 was connected to a fixer forming part of a continuous processing sequence (see FIG. 3). The processing apparatus was an CORAP 72 photographic processor marketed by AGFA-GEVAERT N.V. During approximately 160 min, 43.4 $m^2$ of a graphic arts roomlight stable duplicating film, being exposed as to render 50% of the silver halide developable, and containing approximately 4 g Ag/$m^2$ were processed. The characteristics of the processing were as follows:

developer (DEV): three times dilute developer (D1); 125 ml/$m^2$ replenishment;

fixer (FIX): five times diluted fixer (F1); 125 ml/$m^2$ replenishment:

wash water 1 (W1): 250 ml/$m^2$ water from W2:

wash water 2 (W2): 250 ml/$m^2$ tap water.

Figure 4:
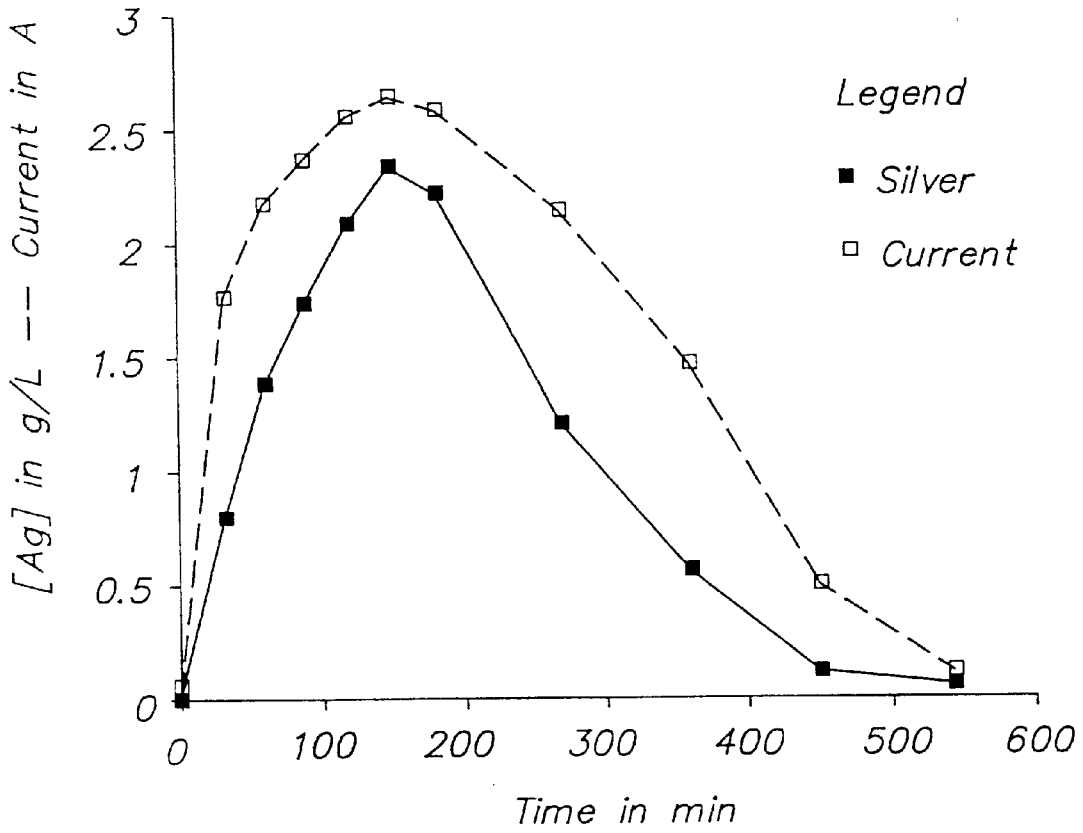
FIG. 4 represents the evolution of electrolytic current and silver content in another desilvering experiment (see example 4).

The desilvering was started about simultaneously with the processing. Desilvering was performed at a cathode potential of −560 mV versus a glass electrode positioned between anode and cathode. Due to ohmic potential drops, currents larger than 2.5 to 3 A were hard to obtain. FIG. 4 shows the silver content and the desilvering current as a function of time. Silver concentrations below 0.1 g/l were readily obtained.

Example 5

Using the apparatus of the present invention a mixture was desilvered consisting of 25% of used three times diluted developer (D1), 25% of used five times diluted fixing solution (F1) and 50% of rinsing water. Due to the high percentage of developer the pH was 8.21. The potentiostat was regulated as to establish a cathode potential of −570 mV versus a glass reference electrode. The container was filled with 5 l liquid. At the start of the desilvering the silver concentration was 0.21 g/l and the electrolytic current was 0.93 A. At the end of the desilvering the residual silver concentration was 0.002 g/l and the residual electrolytic current was 100 mA. The end pH was 8.15. These figures demonstrate that an efficient desilvering was achieved.

Example 6

Figure 5:
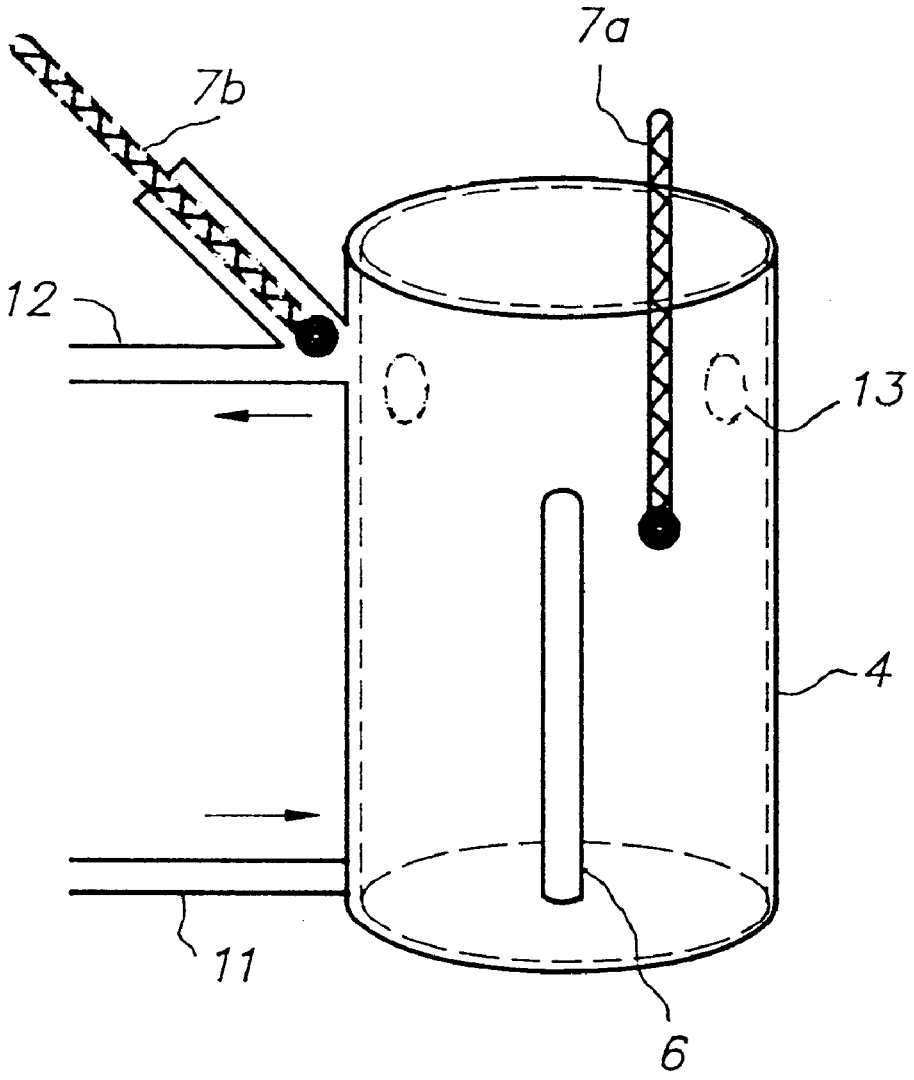
FIG. 5 is an electrolysis unit of a desilvering apparatus according to the present invention showing different possible positions of the reference electrode.

An electrolysis unit as described in example 1 was used for this example. The positioning of the reference electrode was investigated (FIG. 5).

Position 7*a* refers in this figure to a position of the glass bulb of the glass electrode between anode and cathode, at a distance of about 2.5 cm from the cathode.

Position 7*b* refers to a position of the glass bulb of the glass electrode immediately in front of a hole in the cathode. In this case the glass electrode is fixed by means of a special Y-shaped plastic holder which combines with the liquid outlet.

Figure 6:
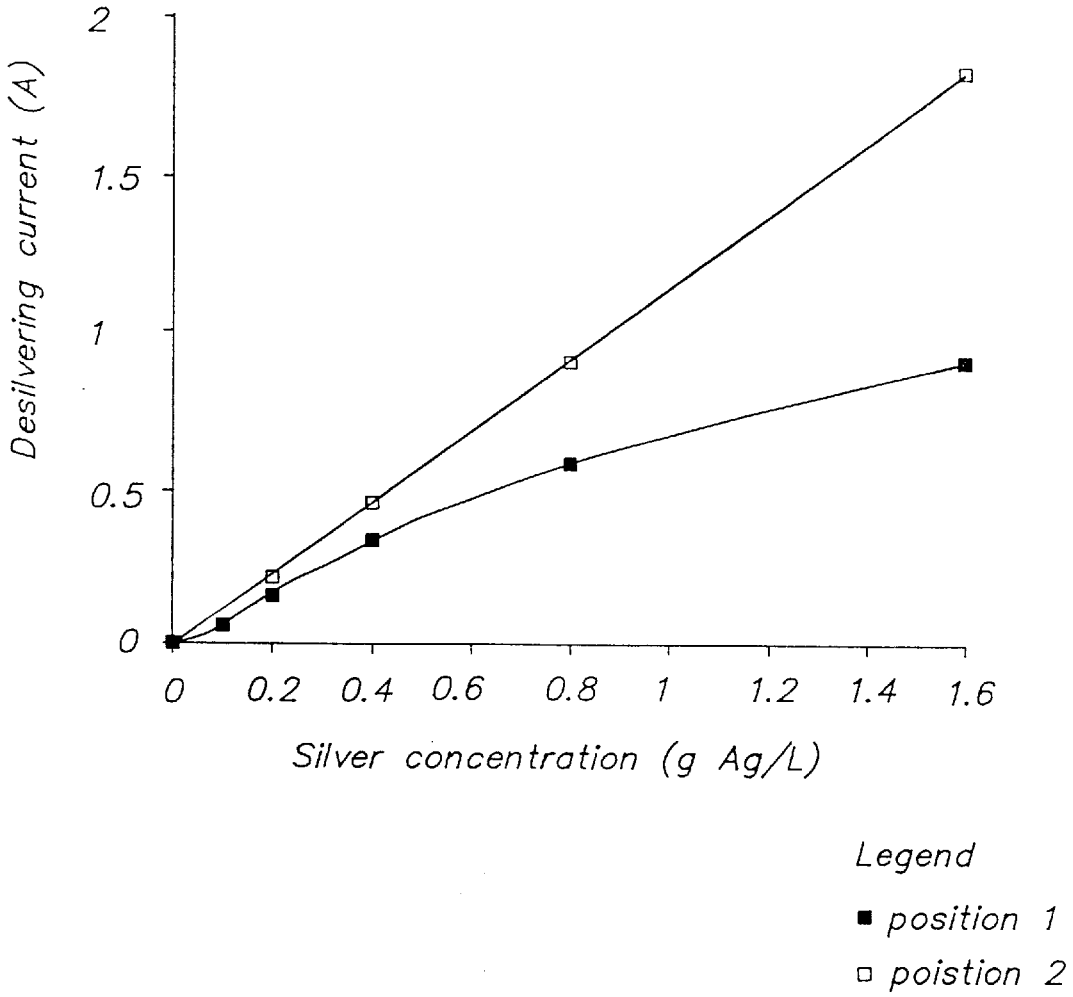
FIG. 6 shows the evolution of the desilvering current as a function of silver concentration in an experiment according to example 6.

FIG. 6 shows the currents measured for different values of the silver content in a fixer of pH 5.3 In position 2, the glass electrode is much less susceptible to the influence of ohmic potential drops, and higher current are obtainted, resulting in faster desilvering.

According to the invention, the presently described apparatus is particularly suitable for performing electrolytic desilvering of a photographic processing solution wherein the processing solution is a fixing solution or a bleaching solution having a pH between 3.8 and 8.5 and the fixing solution or bleaching solution contains, before desilvering, at least 2 gram ions of sulphite per liter.

What is claimed is:

1. Apparatus for performing electrolytic desilvering of a photographic processing solution comprising an electrolysis unit comprising a cathode, an anode and a reference electrode, said reference electrode being a pH sensitive electrode, and said apparatus including a potentiostatic unit for maintaining said cathode at a constant potential versus said reference electrode whereby adjustments for pH variations are automatically performed controlling said desilvering.

2. Apparatus according to claim 1 wherein said apparatus further comprises an extra potentiostatic control unit for compensating ohmic potential drops.

3. Apparatus according to claim 1 wherein said pH sensitive reference electrode is a glass electrode.

4. Apparatus according to claim 1 wherein said cathode has a cylindrical form and is positioned near the wall of said electrolysis unit.

5. Apparatus according to claim 4 wherein said cylindrical cathode has a hole and the pH reference electrode is positioned near to said hole outside the space between cathode and anode.

6. Apparatus according to claim 1 wherein said photographic processing solution is a fixing solution or bleach-fixing solution having a pH between 3.8 and 8.5.

7. Apparatus according to claim 6 wherein said fixing solution or bleach-fixing solution contains before desilvering at least 2 gram ions of sulphite per liter.

8. Method for performing electrolytic desilvering of a photographic processing solution using an apparatus according to claim 1 wherein said electrolytic desilvering is performed batch-wise.

9. Method for performing electrolytic desilvering of a photographic processing solution using an apparatus according to claim 1 wherein said electrolytic desilvering is performed on-line, said electrolysis unit being connected to a fixer tank forming part of a continuous automatic processor.

* * * * *